United States Patent [19]

Langer

[11] 4,372,424

[45] Feb. 8, 1983

[54] SAFETY DEVICE FOR SCAFFOLDINGS

[76] Inventor: Ruth Langer, Ochsenbacher Strasse, 7129 Güglingen-Eibensbach, (Württemberg), Fed. Rep. of Germany

[21] Appl. No.: 266,344

[22] Filed: May 22, 1981

[30] Foreign Application Priority Data

May 29, 1980 [DE] Fed. Rep. of Germany ..... 3020389

[51] Int. Cl.[3] ..... E04G 5/08; E04G 7/28

[52] U.S. Cl. ..... 182/119; 182/179; 182/222

[58] Field of Search ..... 182/222, 223, 119, 178, 182/179, 230, 129

[56] References Cited

U.S. PATENT DOCUMENTS

| | | | |
|---|---|---|---|
| 2,101,245 | 12/1937 | De Franco | 182/119 |
| 2,430,642 | 11/1947 | Mahaffey | 182/119 |
| 2,619,390 | 11/1952 | Johnson | 182/222 |
| 2,656,224 | 10/1953 | Gray | 182/179 |
| 3,213,964 | 10/1965 | Tucker | 182/119 |
| 3,305,046 | 2/1967 | Schar | 182/222 |
| 3,306,397 | 2/1967 | Brumenshenkel | 182/179 |
| 3,854,552 | 12/1974 | Kensrue | 182/222 |
| 4,340,130 | 7/1982 | Payne | 182/119 |

*Primary Examiner*—Reinaldo P. Machado
*Attorney, Agent, or Firm*—Michael J. Striker

[57] ABSTRACT

In a scaffolding assembled of vertical posts, trough-shaped crossbars secured to the posts and gangplanks hooked on the edges of crossbars by claws, a safety device for securing the gangplanks against accidental lifting includes oblong holes formed in the bottom of the trough-shaped crossbars, a rail arranged above each crossbar and overlapping the claws, each rail being provided with a downwardly directed projection formed at its end with a bent portion insertable into the holes and engageable with the crossbar, and a locking plate hinged to the end of the rail which is situated away from the direction of bending of the hook-shaped portions.

5 Claims, 6 Drawing Figures

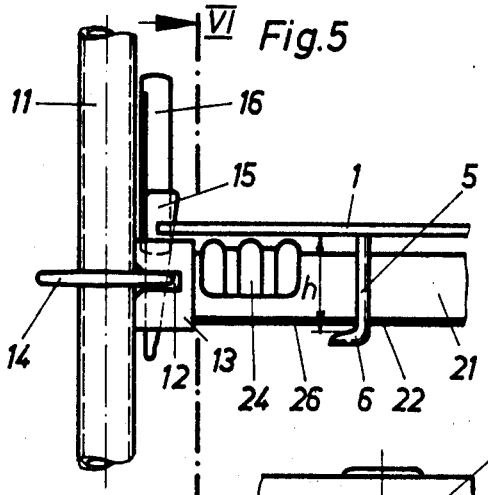
Fig.5
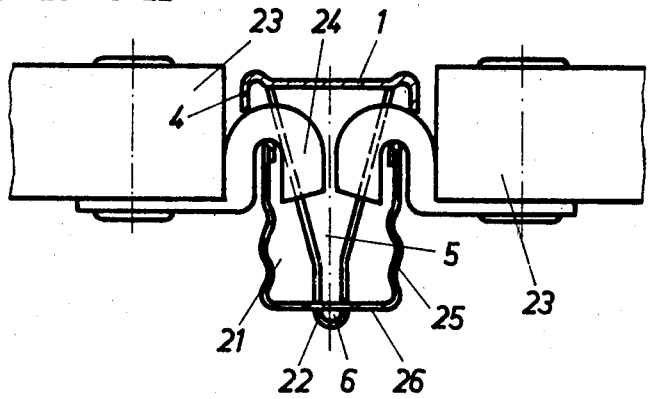
Fig. 6
Fig. 4
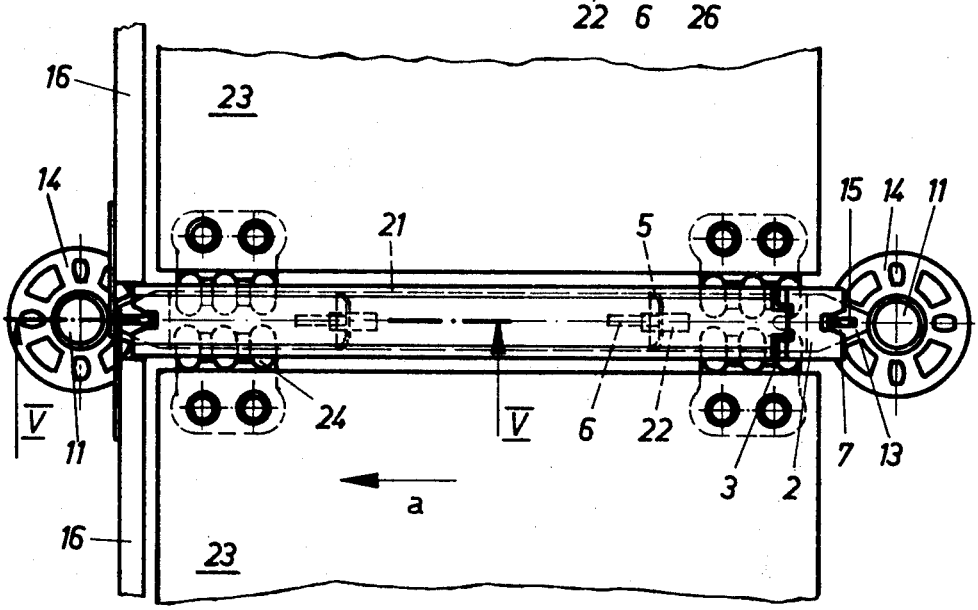

SAFETY DEVICE FOR SCAFFOLDINGS

BACKGROUND OF THE INVENTION

The present invention relates in general to scaffoldings, and in particular to a device for protecting against lifting of gangplanks of scaffoldings assembled of vertical supports, trough-shaped crossbars secured to the supports, and claw hooks for mounting the gangplanks to the crossbars.

In prior-art scaffoldings, it is known to hook gangplanks by means of claw hooks on edges of U-shaped or trough-shaped crossbars. Conventionally, a scaffolding of this type is reinforced in longitudinal direction by elongated crossbars. It has also been known, however, to employ gangplanks of such strength or rigidity as to render the longitudinal crossbars unnecessary and serve themselves as reinforcing elements. In this case, however, a difficulty is encountered in the actual embodiment when for example during an obliquely acting pressure or tensile load resulting for instance from the wind action, the scaffolding due to the torsional deformation is exposed to the danger that the hook-shaped claws are lifted upwardly and dislodged from the crossbars. When no longitudinal crossbars are present, the reinforcing effect of the gangplanks is thus made ineffective and the safety of the entire scaffolding becomes questionable.

SUMMARY OF THE INVENTION

It is therefore a general object of the present invention to overcome the aforementioned disadvantages.

More particularly, it is an object of the invention to provide a device which effectively prevents such lifting and dislodgement of the claw hooks of the gangplanks.

An additional object of the invention is to make the use of longitudinal reinforcing crossbars unnecessary.

A further object of the invention is to provide an improved scaffolding where the function of horizontal reinforcing elements is completely and reliably taken over by the gangplanks.

In keeping with these objects and others which will become apparent hereafter, one feature of the invention resides, in a scaffolding of the aforedescribed type, in the provision of a safety device for protecting against lifting of gangplanks secured to the crossbars of the scaffolding by claw hooks, and the crossbars being mounted between two vertical supports of the scaffolding, the safety device including oblong holes formed in the bottom part of respective crossbars and being oriented in the longitudinal direction of the crossbars, a rail arranged above each crossbar and over the claw hooks, at least one mounting projection fixed to each rail and having a hook-shaped end portion insertable into the oblong hole and engageable with the crossbar, and a locking plate hinged to the end of the rail which is remote from the tip of the hook-shaped end portion of the mounting projection.

Preferably, each rail is formed with several mounting projections, the tips of which are bent at right angles. The safety device of this invention is employed in such a manner that upon placing the claw hooks provided at the end face of each gangplank in the hooked-up position on the edges of the U-shaped crossbars, the protective rails are placed from above into contact with the claw hooks, whereby the bent tips of the mounting projections of the rails pass through the oblong holes in the crossbars while the hinged locking plate is swung upwardly. The mounting projection or projections are located relative to the oblong holes in the crossbars in such a manner that the bent end portions fit the contour of the oblong holes when the hinged locking plate is swung up, whereupon the rail is shifted in the direction of the oblong hole to abut against a vertical support of the scaffolding while the hook-shaped end portion engages the lowermost surface of the crossbar. Thereupon, the locking hinged plate is swung down to abut against the opposite vertical support so that the rail is firmly held in position in contact with the underlying claw hooks. In this manner, any lifting of the claw hooks from the rims of the U-shaped crossbars is effectively prevented.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 4 shows in a plan view a cut away part of a joint of two gangplanks provided with the safety device of this invention in a cut away part of a scaffolding;

FIG. 5 is a sectional side view of a cut away part of the scaffolding of FIG. 4 taken along the line V—V; and FIG. 6 shows on an enlarged scale a sectional front view of a joint of two gangplanks taken along the line VI—VI in FIG. 5.

DESCRIPTION OF THE PREFERRED EMBODIMENT

Figure 2:
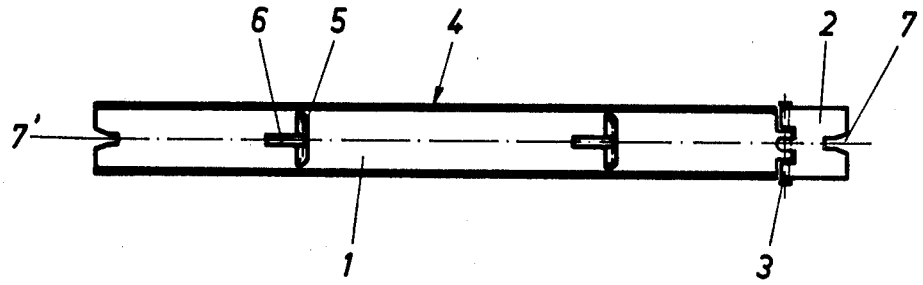
FIG. 2 is a bottom view in the direction of arrow II of the rail of FIG. 1.
Figure 1:
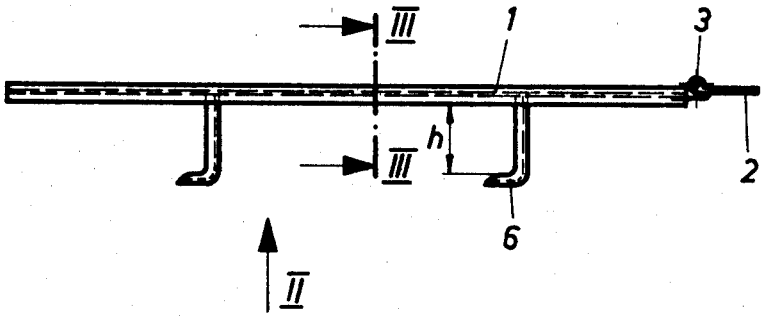
FIG. 1 is a side view of the safety rail according to this invention.
Figure 3:
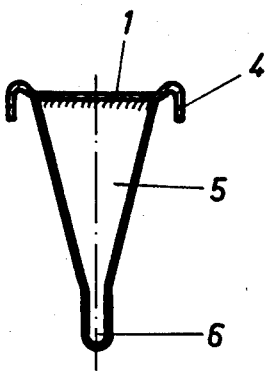
FIG. 3 is a sectional view of the rail of FIG. 1 taken along the line III—III.

In FIG. 1, reference numeral 1 indicates a strip or rail for preventing mounting claw hooks of gangplanks from being lifted from the supporting crossbars. One end of rail 1 is provided with a locking plate 2 swingably secured to the rail by a hinge 3. Both longitudinal edges 4 of rail 1 are turned over downwardly to increase the strength of the rail. The lower side of rail 1 is provided with two mounting projections 5 having a hook-shaped end portion 6. As seen from FIGS. 2 and 3, mounting projections 5 have downwardly tapering form and are made of a metal sheet the edges of which are also turned over to increase the strength of the mounting element. The base of the projection 5 is secured to the bottom surface of rail 1 by welding for example. The hook-shaped end portion 6 of projection 5 is bent at right angles away from the end of the rail at which the hinged plate 2 is mounted. The end edge of the locking plate 2 is provided with a cut-out 7 and a cut-out 7' of the same form is provided at the opposite end of rail 1. The purpose of these cut-outs will be explained below.

The application of the safety device of this invention on a scaffolding is illustrated in FIGS. 4–6. As mentioned before, the scaffolding is of the type in which vertical supports 11 are tied together by horizontally and diagonally mounted scaffolding elements in such a manner that a connecting flange 14 surrounding respective upright supports 14 is inserted into a horizontally directed slot 12 of a connecting shoe 13 and the latter together with an assigned trough-shaped crossbar 21 is held in a fixed position relative to the flange 14 by a wedge 15. Reference numeral 16 denotes lateral planks provided in accordance with regulations relating to scaffoldings.

FIG. 4 illustrates a crossbar 21 mounted between two upright supports 11 in the aforedescribed manner. Bottom 26 of the U-shaped or trough-shaped crossbar 21 is formed with as many oblong holes 22 as many mounting projections 5 are provided on the safety rail 1. Holes 22 are shaped and arranged in such a manner that upon the application of the rail 1 and after its shifting into abutment against the left-hand upright support 11, the hook-like end portion 6 of projection 5 abuts against the corresponding end rim of hole 22 and hooks 6 engage the lower surface of the bottom of crossbar 21. In the course of construction of the scaffolding, gangplanks 23, which are provided at their end faces with claw hooks 24, are hooked one after the other on the edges of upwardly directed sides 25 of respective crossbars 21. Thereupon rail 1 with its hook-shaped projections 5 is inserted from above into the oblong holes 22 and is brought into contact with the top surface of juxtaposed claw hooks 24 of respective gangplanks 23. In doing so, hinged plate 2 is initially swung up so that during the downward movement of the rail the hinge 3 is moved clear of the edge of the wedge 15 and the mounting projections 5 pass through the oblong holes 22. The length h of the upright part of the projection 5, that is the clearance of the hook-shaped end portion 6 from the lower surface of rail 1, is dimensioned such that after rail 1 is brought into its rest position on crossbar 21, the bent portion 6 projects below the outer surface of the bottom 26 of crossbar 21. When rail 1 with its turned-over edges 4 rests on claw hooks 24 of both consecutive gangplanks 23, then the rail is shifted in the direction of arrow a until wedge 15 enters the slot 7' at the corresponding end of rail 1, whereupon locking plate 2 is swung down, whereby its slot 7 is brought into snug engagement with the opposite wedge 15. In shifting rail 1 in the direction of arrow a, bent portions 6 of projection 5 engage from below the bottom of crossbar 21 and by turning down the plate 2 any return movement of rail is blocked. In other words, rail 1 is effectively arrested in its working position, in which the mounting projections 5 and 6 prevent any lift of claws 24 from the crossbars 21.

It will be understood that each of the elements described above, or two or more together, may also find a useful application in other types of constructions differing from the types described above.

While the invention has been illustrated and described as embodied in a specific example of scaffolding, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for protecting against lifting gangplanks of a scaffolding assembled of vertical supports, trough-shaped crossbars secured to the supports, and claw hooks for mounting the gangplanks to the crossbars, said device comprising oblong holes formed in bottom portions of respective crossbars and being oriented in the longitudinal direction of the crossbars; a rail arranged above each crossbar and overlapping the claw hooks; at least one mounting projection fixed to each rail and having a hook-shaped end portion insertable into corresponding oblong hole and engageable with the crossbar; and a locking plate hinged to an end of the rail.

2. A device as defined in claim 1, wherein the hook-shaped end of each mounting projection is bent at right angles in the direction away from the hinged locking plate.

3. A device as defined in claim 1, wherein the free end of said rail and the end of said locking plate are provided respectively with axially directed recesses, and each crossbar being secured at its end to corresponding vertical support by a wedge matching the assigned recess.

4. A device as defined in claim 2, wherein the clearance between the hook-shaped end portion of the mounting projection and the opposite surface of the rail is adjusted to the distance between the outer surface of the bottom of the crossbar and the rail.

5. A device as defined in claim 1, wherein the length of the oblong hole corresponds substantially to the length of said hook-shaped end portion.

* * * * *